United States Patent [19]

Clarkson

[11] Patent Number: 4,730,730

[45] Date of Patent: Mar. 15, 1988

[54] PACKAGE AND METHOD OF FILLING AND DISPENSING A PLURALITY OF BOTTLES

[75] Inventor: Walter J. Clarkson, Fairport, N.Y.

[73] Assignee: Nalge Company, Rochester, N.Y.

[21] Appl. No.: 5,825

[22] Filed: Jan. 21, 1987

[51] Int. Cl.[4] ..... B65D 71/08; B65B 13/00; B65G 65/34

[52] U.S. Cl. ..... 206/497; 53/442; 53/448; 53/449; 206/45.33; 206/432; 229/11; 414/417

[58] Field of Search ..... 53/48, 169, 399, 412, 53/441, 442, 448, 449; 206/45, 33, 427, 429, 431, 432, 497; 221/297, 312 C; 229/7 R, 7 SC, 9, 11, 123; 414/404, 416, 417

[56] References Cited

U.S. PATENT DOCUMENTS

| | | | |
|---|---|---|---|
| 243,875 | 7/1881 | Emery | 229/9 |
| 2,908,121 | 10/1959 | Enos, Jr. . | |
| 3,353,326 | 11/1967 | Becker . | |
| 3,488,913 | 1/1970 | Burgess . | |
| 3,600,872 | 8/1971 | Sharpknack, Jr. | 53/385 |
| 3,675,767 | 7/1972 | Taylor | 53/398 |
| 3,690,453 | 9/1972 | Dorall | 53/441 |
| 3,734,280 | 5/1973 | Amneus et al. | 414/417 |
| 3,750,876 | 8/1973 | Throberg | 206/45.33 |
| 3,788,463 | 1/1974 | Ruff | 206/45.33 |
| 3,942,631 | 3/1976 | Sutherland et al. | 206/44.12 |
| 4,036,362 | 7/1977 | Ullman | 206/432 |
| 4,249,849 | 2/1981 | Hinchcliffe | 414/417 |
| 4,403,463 | 9/1983 | Danti | 53/398 |
| 4,636,477 | 1/1987 | Ronka et al. | 414/417 |

FOREIGN PATENT DOCUMENTS

| | | | |
|---|---|---|---|
| 2477509 | 9/1981 | France | 206/497 |

*Primary Examiner*—Jimmy G. Foster
*Attorney, Agent, or Firm*—Marjama & Pincelli

[57] ABSTRACT

A package and method of packaging and dispensing a plurality of bottles or other like articles. The packages include a tray for supporting a plurality of bottles and a band around the perimeter of the bottles. A shrink wrap is placed around the bottles, band and tray. The tray is filled by placing the open edge adjacent the exit port of shaker dispensing table. The bottles are dispensed from the tray by moving the band to cause the bottles to slide over the open edge of the tray onto a receiving table.

12 Claims, 6 Drawing Figures

PACKAGE AND METHOD OF FILLING AND DISPENSING A PLURALITY OF BOTTLES

BACKGROUND OF THE INVENTION

The present invention relates to packaging for holding a plurality of bottles or other like articles. The present invention is particularly adapted for holding a plurality of plastic bottles to be used in the medical diagnostic field.

Plastic bottles when sold in large quantities to bottlers are typically bulk packaged, that is, randomly placed in a shipping container. When these bottles are to be filled by an automatic filling machine, they must be oriented on the receiving table of the filling machine so that the open end is facing in the upward direction. This orientation may be accomplished either manually or by use of an expensive unscrambling device.

In the medical diagnostic field bottles (generally from ½ ounce to 8 ounces in size) are filled with a variety of liquid reagents. Typically these glass bottles are packaged solely by the placement of a shrink wrap around a single layer of bottles. A plurality of layers of bottles are placed in a shipping container, one upon the other, with a cardboard sheet between layers. Each packaged layer of bottles is quite flexible and requires a certain amount of care in removing the bottles from the container and placing them on the receiving table of the filling machine. Since each layer is simply placed in the container there is always the possibility that during shipment the bottles may shift within the container possibly cause breakage of the bottles. In dispensing of the bottles onto a receiving table of an automatic filling machine, the shrink wrap and the bottles are slid over the bottom portion of the wrapping. This is generally accomplished by the use of a bar or U-shaped tool to push the bottles over the shrink wrap. If there is a tear or other flaw in the film there exists the possibility of the bottles catching and being knocked over.

Plastic bottles require a certain degree of care when placed on a receiving table of an automatic filling machine. A typical receiving table of an automatic filling machine comprises a rotating table which causes the bottles to funnel down into the entry portion of a filling machine. Since plastic bottles are substantially lighter than glass there exists the problem of placing the plastic bottles onto the rotating table and preventing the bottles from falling over during this operation.

In the medical diagnostic field there also exists the requirement that the bottles be sterilized and maintain such through the bottling operation. The use of an unscrambler or other manual means for orienting the bottles on the receiving table requires extra precautions and/or expense in doing so.

Applicants have invented an improved package and method of packaging and dispensing bottles or other like articles which minimizes or eliminates the problems of the prior art.

SUMMARY OF THE INVENTION

A package for holding a plurality of bottles or other like articles. The package includes a tray having a bottom supporting surface, upstanding confining wall and one open dispensing edge. A band is provided for surrounding and confining the bottles placed on said tray. A sheet of heat shrinkable film is shrunken around said tray, band and bottles.

A method of packaging and/or dispensing a plurality of bottles or other like articles in a tray having a bottom, an upstanding outer confining wall and one open dispensing edge. The tray is filled with a plurality plastic bottles by positioning the dispensing edge against a shaker table which dispenses bottles onto the tray until said tray is filled. A band is then placed around the bottles for surrounding and confining the bottles on said tray. The tray, bottles and band are surrounded with a sheet of heat shrinkable material. Heat is applied so as to cause the shrinkable material to shrink tightly around said tray, band and bottles. The bottles are dispensed by removing the sheet of shrinkable material and moving the bottles over the dispensing edge by moving the band.

DETAILED DESCRIPTION OF THE INVENTION

Figure 1:
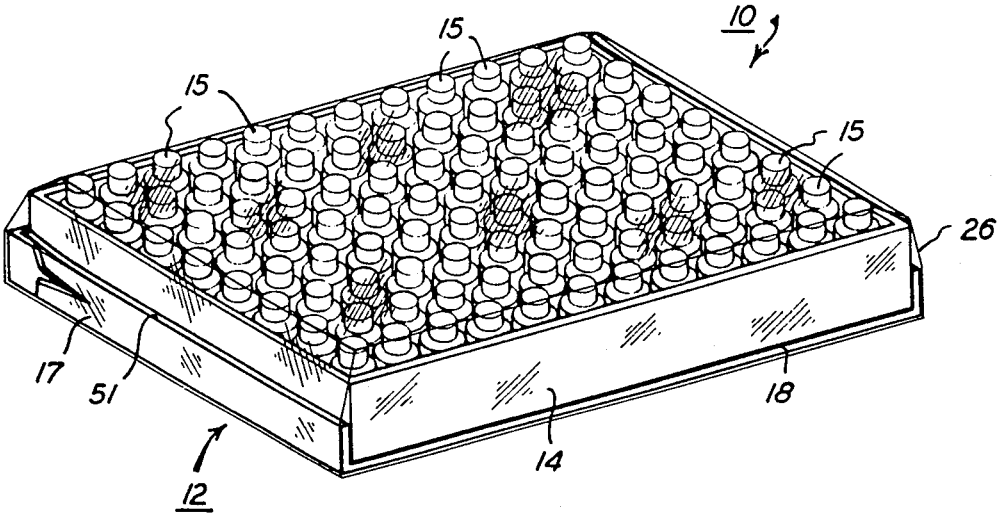
FIG. 1 is a perspective view of package made in accordance with the present invention.

Referring to FIG. 1, there is illustrated a package 10 made in accordance with the present invention for holding a plurality of bottles or other like articles. The present invention is particularly useful for small bottles, preferably less than about 4 ounces. In the particular embodiment illustrated there is illustrated a plurality of plastic bottles 15 each having the approximate size of ¾" (1.90 cm) in diameter and 2" (5.08 cm) in height (approximately ½ ounce). Package 10 includes tray 12 and a band 14 for surrounding and confining the bottles 15 placed on tray 12. Tray 12 comprises a substantially smooth supporting surface 16 outer confining wall 17 and an open dispensing edge 18. In the particular embodiment illustrated, the outer confining wall comprises three upstanding side walls 20, 22, 24 each having an inside surface 21, 23, 25 respectively which forms a substantially rectangular support surface 19. In the preferred embodiment as illustrated open dispensing edge 18 is substantially straight. Band 14 is disposed on the tray 12 adjacent inside surfaces 21, 23, 25 of walls 20, 22 24. Placed around the bottles, band and tray is a sheet 26 of heat shrinkable material which has been tightly shrunken therearound for positively holding in position the bottle 15, tray 12, and band 14 during shipment and storage. The heat shrinkable material may be of many known and used materials. In the particular embodiment illustrated sheet 26 is made of 0.0075" polyethylene film which is readily available in the market place.

Figure 6:
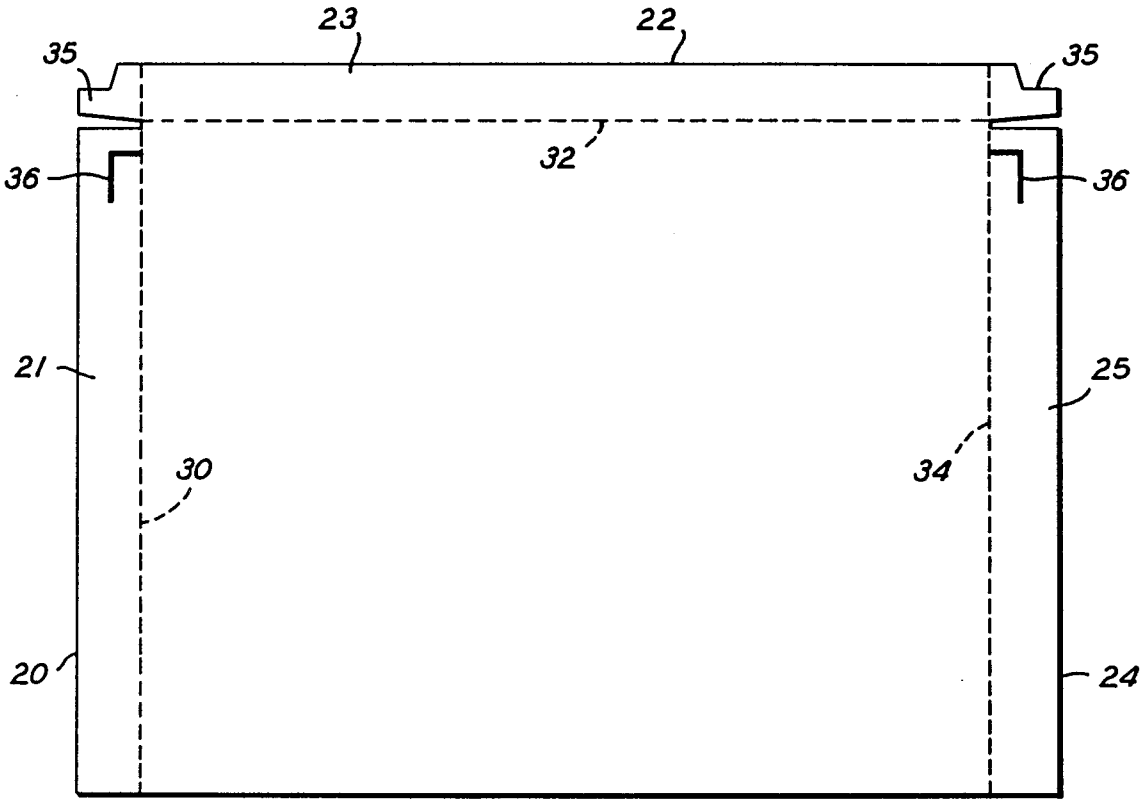
FIG. 6 is a plan view of a blank used to fabricate the tray of the package of FIG. 1.

Tray 12 is preferably formed of a rigid fiber fabricated paper capable of maintaining its shape when bottles 15 have been placed thereon. In the particular embodiment illustrated the tray 12 is made of cardboard, however tray 12 may be made of any other material capable of holding its shape. Tray 12 is made of a single blank pieces of cardboard (see FIG. 6) having three fold lines 30, 32 and 34 such when the blank is folded along lines 30, 32 and 34 sides 20, 22 and 24 are formed. The middle wall 22 is provided with a pair of projections for placement into an opening in walls 20, 24 such that when upstanding walls 20, 22, 24 are placed in the substantially vertical position the projections 35 mate in opening 36 for maintaining side walls 20, 22 and 24 in a substantially upright position.

Figure 5:
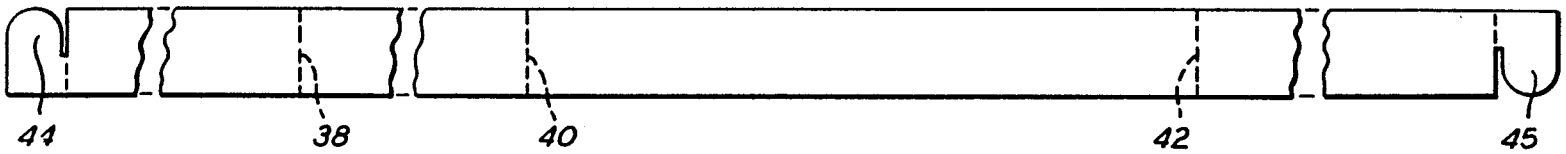
FIG. 5 is a plan view of a blank used to fabricate the band of the package of FIG. 1.

In the particular embodiment illustrated, band 14 is also formed of a single continuous strip of material (see FIG. 5) having three folds lines 38, 40 and 42 having latch means at terminal ends 44, 45 for securing band 14 in a closed loop. In the embodiment illustrated latch means comprises mating slots in ends 44, 45. However, any other securing means may be used. The band 14 is preferably of a rigid material for ease of use when placed on tray 12 and for confining bottles 15. In the particular embodiment band 14 is made of cardboard.

Figure 3:
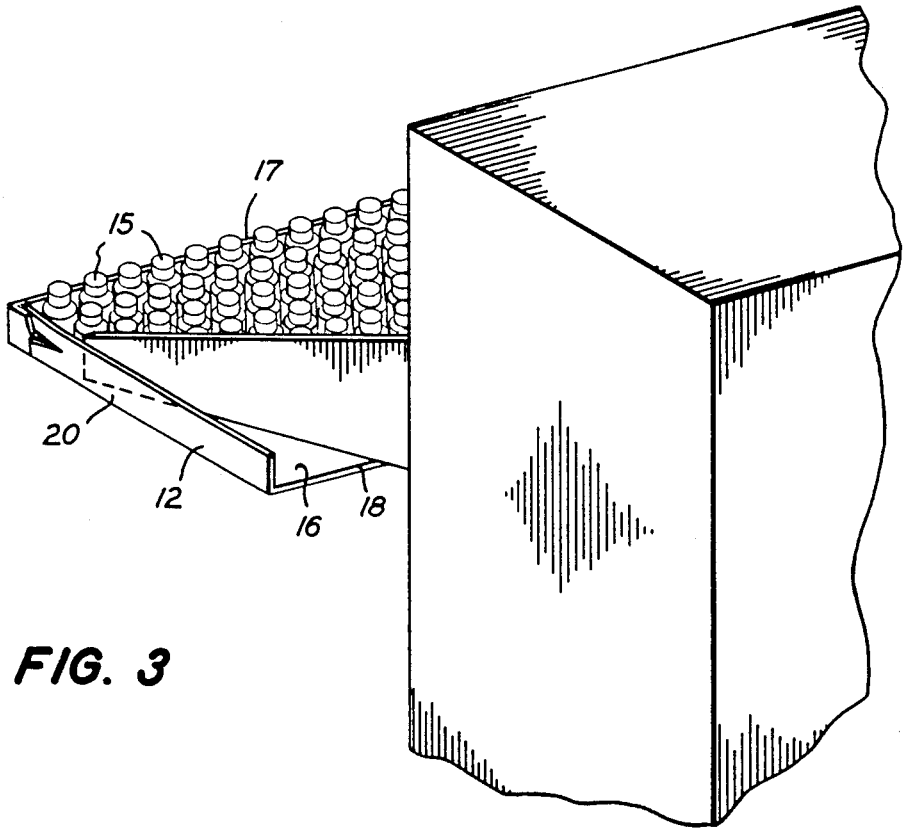
FIG. 3 is a partial perspective of the package of FIG. 1 is filled with bottles.
Figure 2:
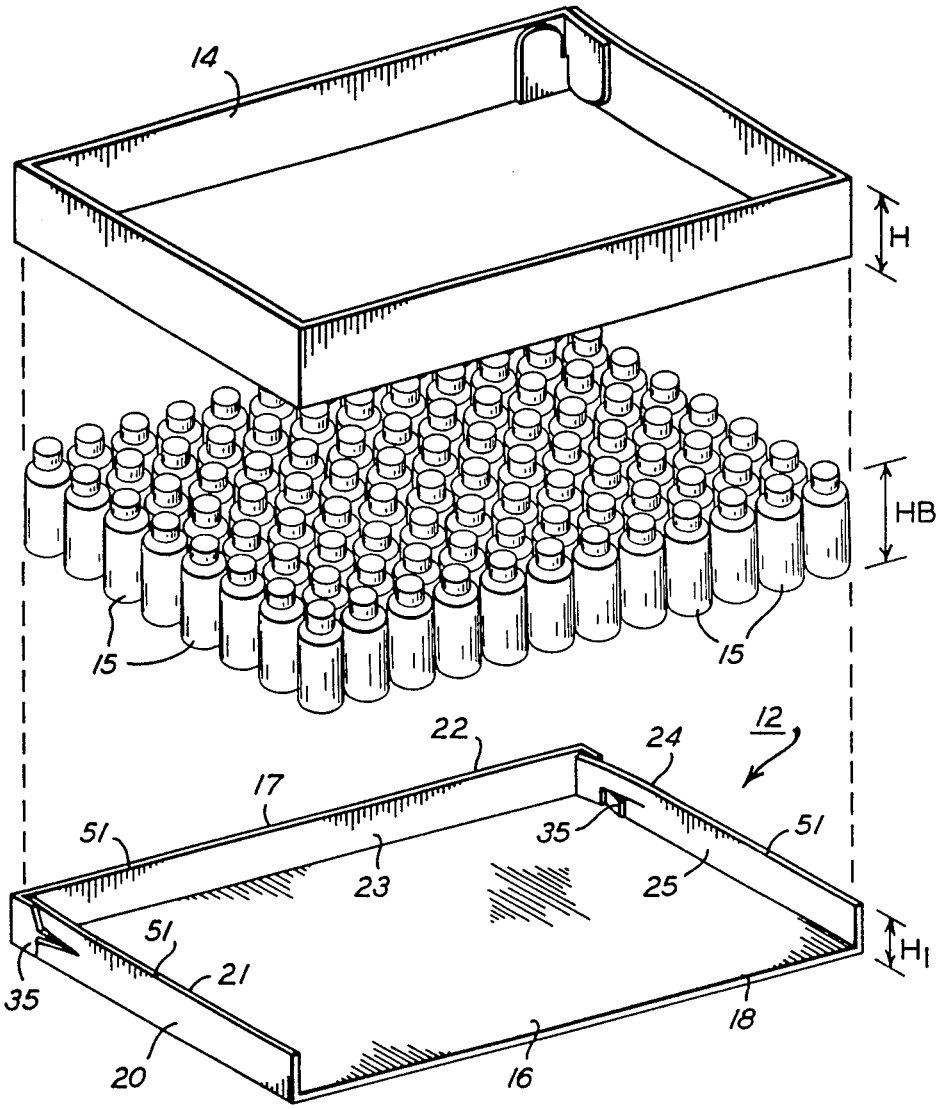
FIG. 2 is an exploded view of the package of FIG. 1 with the shrink wrap removed.

Referring to FIG. 3, there is illustrated the general manner in which the tray is initially filled with bottles 15. The open dispensing edge 18 of tray 12 is placed adjacent the exit port of a dispensing shaker table such that the bottles will flow directly onto the tray onto the bottom surface 13 of tray 12 until filled. The particular shaker table illustrated is merely illustrative as shaker tables are commonly used in packaging. In the particular embodiment illustrated, tray 12 will hold approximately 150 individual bottles. Once the tray 12 is filled it is removed therefrom and band 14 is placed around the bottles on tray 12 and latched. The latch means provides quick and easy confining of the bottles. The band is simply placed around the bottles and the ends are latched together. Thereafter, the tray 12 with the band 14 and bottles 15 are taken to a device where a sheet 26 of heat shrinkable material is shrunken around the bottles, band and tray for securely holding the assembly together. Typically, sheet 26 is shrunk by the application of heat.

The assembled package 10 provides a very stable configuration which minimizes or eliminates any relative movement between the bottles during shipment. Additionally, the package 10 provides a relatively stiff assembly for ease of removing from the shipping container and placement onto the receiving table of an automatic filling machine.

The bottles 15 are dispensed onto tray 12 such that the open ends 30 face upwards with only the sheet 26 covering the bottles. The package can be simply sterilized by any method desired. For example, gamma radiation or ethylene oxide. Once sterilized, the users need not directly handle the bottles until filled and capped.

Figure 4:
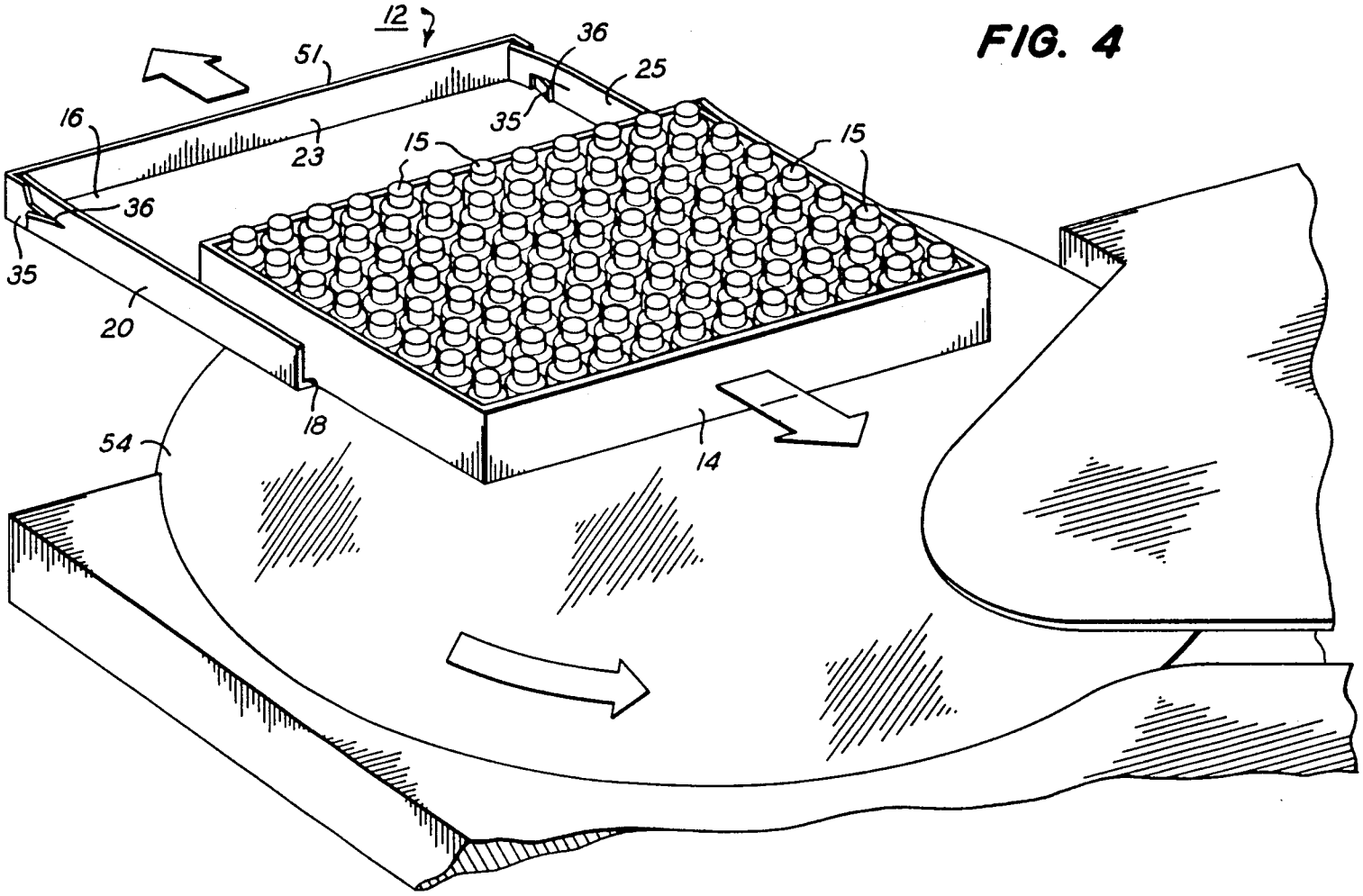
FIG. 4 is a partial perspective view illustrating how the bottles disposed thereon may be removed from the package onto a receiving table of an automatic filling machine.

The height H1 side walls 20, 22, 24 of tray 12 is preferably at least one half height HB of the bottles and preferably at least above the height H of band 14. Dispensing of the bottles is accomplished after the shrinkable material 26 is removed. Sheet 26 is preferably removed by the use of a cutting implement which cuts around the package whereby the sheet 26 can be easily removed. The top edge 51 of side walls 20, 22 and 24 may be used as a guide for a cutting implement such that the cutting implement may be slid along the top edge 51 of tray 12 around package 10 as that sheet 26 may be easily removed. If so desired the open edge 18 can be extended beyond the ends of sides 20, 24 a short distance, for example, about ¼" so as to provide a guide for cutting of sheet 26 there along. Additionally, this minimizes the amount of sheet 26 on which bottles 15 will slide over. Thereafter, the tray 12 is placed on a receiving table 54 of an automatic filling machine for receiving the bottles (see FIG. 4). The bottles 15 are dispensed by placing the tray 12 on the receiving table and moving the band such that the bottles 15 will slide over the open edge 18 onto the receiving table 15. Since the bottom surface 16 is smooth the bottles can easily slide off and avoid catching on any opening in the sheet 26 or any friction between the bottles and shrink wrap. Use of the band provides means for quick and easy dispensing of the bottles and minimizes external contact with bottles. Once all the bottles have been placed on the receiving table band 14 is simply lifted up and away from the bottles. In the present and preferred form of the invention, the band is sufficiently rigid so as to allow bottles to be simply pushed off, however, the band may be of a more flexible nature so as to be allowed to be pulled off the tray.

Various modifications may be made with departing from the scope of the present invention. For example, while the preferred embodiment illustrates a substantially rectangular tray, other shapes may be used such as triangular or circular so long as there is a confining outer wall and a dispensing edge. Additionally, the band may be a integrally formed closed loop if so desired. Further, while band 14 is preferably disposed adjacent the inside surface of the confining wall, the band may be placed directly above the upstanding walls and along the open edge.

What is claimed is:

1. A package adapted for holding a plurality of bottles or other like articles comprising:

a tray having a bottom supporting surface, an upstanding confining wall and one open dispensing edge;

a band for surrounding and confining said bottles placed on said tray;

a sheet of heat shrinkable film shrunken around said tray, band and bottles.

2. A package adapted for holding a plurality of bottles or other like articles comprising:

a tray having a bottom supporting surface, three upstanding side walls and one open dispensing edge;

a band for surrounding and confining said bottles placed on said tray adjacent the inside surface of said three upstanding side walls;

a sheet of heat shrinkable film shrunken around said tray, band and bottles.

3. A package according to claim 2 wherein said tray is made of a single blank having three folds, one associated with each side wall for defining said three upstanding side walls, said side walls having means for locking said side walls together in an upright position, said means comprising said upstanding walls between said other two walls having a one projection at both ends of for placement in a receiving slot in each of said other two side walls.

4. A package according to claim 2 wherein the bottles are positioned on said tray so that the open end of said bottles faces away from said tray and said package having nothing between said top opening of said bottles and said film.

5. A package according to claim 2 wherein said package is capable of being sterilized by gamma radiation or ethylene oxide without degragation.

6. A package for holding a plurality of plastic bottles or other like articles comprising:

a fabricated paper rigid tray having a substantially rectangular bottom supporting surface, three upstanding side walls and one open substantially straight edge;

an open band surrounding and confining said bottles placed on said tray, said band having means for securing said band in a closed loop, said band being disposed adjacent the inside surface of said three upstanding side walls;

a sheet of heat shrinkable film shrunken around said tray, band and bottles disposed thereon.

7. A package adapted for holding a plurality of plastic bottles or other like articles comprising:

a rigid tray having a substantially rectangular bottom supporting surface, three upstanding side walls and one open substantially straight edge;

an open band having four sides for surrounding and confining said bottles placed on said tray, said band having means for securing said band in a closed loop, said band being disposed adjacent the inside surface of said three upstanding side walls;

a sheet of heat shrinkable film shrunken around said tray, band and bottles disposed thereon.

8. A method of packaging a plurality of bottles or other like articles in a tray having a bottom, an upstanding outer confining wall and one open dispensing edge comprising the steps of:

filling said tray with a plurality plastic bottles by positioning said dispensing edge against a shaker table which dispenses said bottles on to said tray until said tray is filled;

placing a band around said bottles for surrounding and confining said bottles on said tray;

enclosing said tray, bottles and band with a sheet of heat shrinkable material;

applying heat so as to cause said shrinkable material to shrink tightly around said tray, band and bottles.

9. A method of packaging a plurality of plastic bottles or other like articles in a tray having a bottom, three upstanding side walls and one open substantially straight edge comprising the steps of:

filling said tray with a plurality of plastic bottles by positioning said open substantially straight edge against a shaker table which dispenses said bottles on to said tray until said tray is filled;

placing a band around said bottles for surrounding and confining said bottles on said tray, said band being positioned directly adjacent the inside surface of said upstanding walls;

enclosing said tray, bottles and band with a sheet of heat shrinkable material;

applying heat so as to cause said shrinkable material to shrink tightly around said tray, band and bottles.

10. A method of packaging and dispensing a plurality of plastic bottles or other like articles on a tray having a bottom, three upstanding walls and one open straight edge comprising the steps of:

filling said tray with a plurality of plastic bottles by positioning said substantially straight edge against a shaker table which dispenses said bottles on to said tray until said tray is filled;

placing a band around said bottles for surrounding and confining said bottles on said tray and directly adjacent inside surface of said upstanding walls;

enclosing said tray, band and bottles with a sheet of shrinkable material;

apply heat to shrink said sheet tightly around said tray, band and bottles;

dispensing said bottles by removing said sheet of heat shrinkable material and placing said open end of said tray on a receiving table;

removing said bottles from said tray on to said receiving table by sliding said bottles off said tray over said open edge by moving said band.

11. A method of packaging and dispensing a plurality of plastic bottles or other like articles on a tray having a bottom, an upstanding outer confining wall and one open edge comprising the steps of:

filling said tray with a plurality of bottles by positioning said open edge against a shaker table which dispenses said bottles on to said tray until said tray is filled;

placing a band around said bottles for surrounding and confining said bottles on said tray;

enclosing said tray, band and bottles with a sheet of shrinkable material;

applying shrink means to said shrinkable material to cause said sheet to shrink tightly around said tray, band and bottles;

dispensing said bottles by removing said sheet of heat shrinkable material and placing said open end in said tray against a receiving table;

removing said bottles from said tray on to said receiving table by sliding said bottles off said tray over said open edge by moving said band.

12. A method of dispensing a plurality of plastic bottles or other like articles on a tray having the bottom, an upstanding outer confining wall and one open edge, a band surrounding and confining said bottles and a sheet of shrinkable material shrunk around said bottles, tray and band, comprising the steps of:

dispensing said bottles by removing said sheet of heat shrinkable material and placing said open end of said tray on a receiving table;

removing said bottles from said tray on to said receiving table by sliding said bottles off said tray over said open edge by moving said band.

* * * * *